US005769517A

United States Patent [19]

Carde

[11] Patent Number: 5,769,517

[45] Date of Patent: Jun. 23, 1998

[54] DRAWER SAFETY LOCK

[76] Inventor: Felix Carde, 142 Governors Hill Rd., Oxford, Conn. 06478

[21] Appl. No.: 601,571

[22] Filed: Feb. 14, 1996

[51] Int. Cl.[6] ..... A47B 88/00

[52] U.S. Cl. ..... 312/333; 312/334.47; 292/238

[58] Field of Search ..... 312/333, 334.44, 312/334.47, 215; 292/230, 238; 70/85, 86, 87, 88

[56] References Cited

U.S. PATENT DOCUMENTS

| | | | |
|---|---|---|---|
| 563,061 | 6/1896 | Price | 70/88 |
| 3,381,992 | 5/1968 | Friesen . | |
| 3,397,001 | 8/1968 | Friedman . | |
| 3,850,463 | 11/1974 | Hawkins . | |
| 3,888,525 | 6/1975 | Kousens | 312/333 X |
| 3,889,992 | 6/1975 | Shelton . | |
| 4,065,196 | 12/1977 | Stein | 312/333 |
| 4,139,249 | 2/1979 | Hillman . | |
| 4,505,526 | 3/1985 | Leck . | |
| 5,292,198 | 3/1994 | Rock et al. | 312/333 X |
| 5,344,226 | 9/1994 | Lee . | |
| 5,445,451 | 8/1995 | Harmony . | |

FOREIGN PATENT DOCUMENTS

| | | | |
|---|---|---|---|
| 2508643 | 9/1976 | Germany | 312/334.47 |
| 2932123 | 2/1981 | Germany | 312/333 |
| 678871 | 9/1952 | United Kingdom | 292/238 |
| 2103708 | 2/1983 | United Kingdom | 70/85 |
| 2216780 | 10/1989 | United Kingdom | 312/333 |

*Primary Examiner*—Jose V. Chen
*Assistant Examiner*—Hanh V. Tran
*Attorney, Agent, or Firm*—Ware Fressola Van Der Sluys & Adolphson

[57] ABSTRACT

A drawer safety lock includes a counterbalanced latch plate, pivotally moveable manually between an upwardly pivoted limit position and an unlocked position, normally counterbalanced toward the limit position, and a latch plate stop, positioned with respect to the latch plate for restricting movement of the latch plate beyond the upwardly pivoted limit position, so that the safety lock requires no resilient bending or flexible spring action for its operating movement.

19 Claims, 4 Drawing Sheets

DRAWER SAFETY LOCK

BACKGROUND OF THE INVENTION

The present invention generally relates to a drawer safety lock attachable to a drawer, and in particular, it relates to one such drawer safety lock, including both a pivoting latch plate and a latch plate stop, which operates without the use of spring biasing or resilient bending.

Drawer safety locks have been used for years to prevent young children and infants from gaining access to valuable papers and articles as well as potentially harmful items, such as poisons or firearms, stored in cabinet and desk drawers. Those locks which are not key operated typically are unlocked by the actuation of a release switch, which is either hidden from or inaccessible to small children and infants, since cabinet and desk drawers are normally made of wood, the drawer safety locks of this invention are readily attachable to the interior wooden sidewalls of these drawers by the user, employing two or three small screws shown in FIGS. 1, 5 and 6 of the drawings.

Regardless of the particular locking arrangement, many drawer safety locks employ spring biasing to engage the drawer lock with a drawer frame, or other structure in which the drawer slides, to prevent the drawer from opening. Spring biased locks generally are intricate and costly, but have a relatively long service life. As an example, U.S. Pat. No. 4,139,249 issued to Hillman on Feb. 13, 1979, discloses a child-proof cabinet latch having a base and a restraining member slidable in a guide channel defined by the base. A spring is employed to bias the restraining member toward a locked position to engage a cabinet frame and permit only limited opening of the drawer. Similarly, U.S. Pat. No. 5,344,226 issued to Lee on Sept. 6, 1994, discloses a drawer safety device having a sliding locking assembly which is biased by a spring to engage the desk and lock the drawer.

As an alternative to spring biased arrangements, drawer safety locks have employed a variety of resilient bending configurations. In place of a spring, a bent metal or plastic member is used to engage a locking mechanism. Resilient bending locks tend to be simpler and less expensive to manufacture than their spring biased counterparts. However, they can fatigue and break over time. An example of a resilient bending lock is disclosed in U.S. Pat. No. 3,397,001 issued to N. R. Friedman on Aug. 13, 1968. Friedman discloses a closure latch assembly which includes a mounting base and a closure latch, positioned to engage the mounting base, so that a drawer cannot be opened. However, the closure latch can be bent away from the mounting base to allow the drawer to be opened.

U.S. Pat. No. 3,889,992 issued to Shelton on Jun. 17, 1975, discloses a locking arrangement similar to that of Friedman and includes a stop, mounted to a desk and a resilient arm, having a ball on the end, which engages the stop to prevent the drawer from opening. As with the closure latch of Friedman, the arm can be bent away from the stop so that the drawer can be opened.

Because of the inherent limitations of spring biased and resilient bending drawer safety locks as discussed above, a simple and inexpensive drawer safety lock, having a long service life, which does not rely upon spring biasing or resilient bending, is highly desirable.

SUMMARY OF THE INVENTION

The present invention is designed to overcome the limitations discussed above and towards that end it includes a novel drawer safety lock which is inexpensive and simple to manufacture and provides a long service life without relying upon spring biasing or resilient bending. The device includes a pivoting latch plate, pivotally moveable between a locked position and an unlocked position, and a latch plate stop, positioned with respect to the pivoting latch plate for restricting movement of the pivoting latch plate beyond the locked position.

Advantages of the present drawer safety lock over the prior art will become apparent to those skilled in the art from the following detailed description read in conjunction with the appended claims and drawings attached hereto.

BRIEF DESCRIPTION OF THE DRAWINGS

The drawings, not drawn to scale, include.

DESCRIPTION OF THE PREFERRED EMBODIMENT

Figure 1:
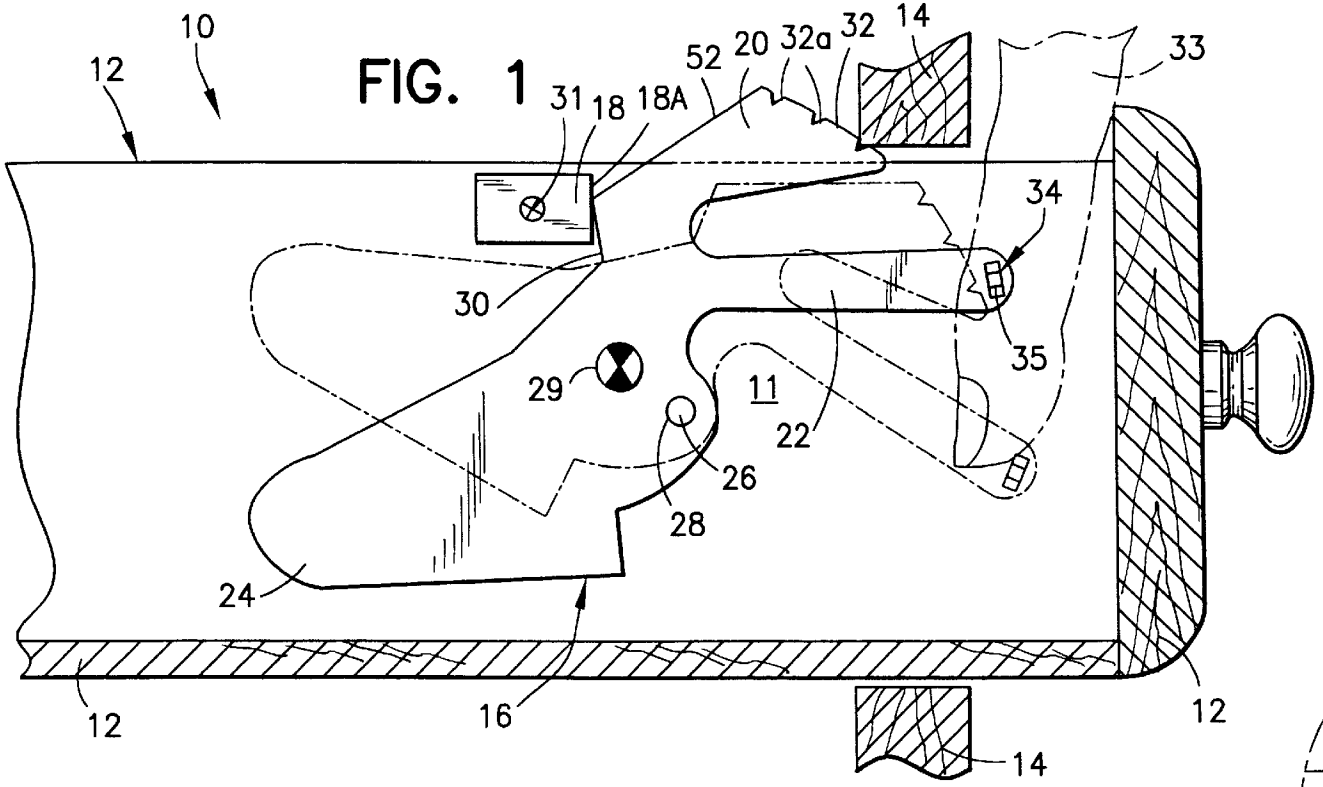
FIG. 1, which is a side elevation view of a drawer safety lock embodying the principles of the present invention.

A drawer safety lock, generally indicated at 10 in FIG. 1 and embodying the principles of the present invention, is shown attached to a sidewall 11 of drawer 12, slidable within drawer frame 14, and includes a pivoting latch plate 16 and a fixed latch plate stop 18.

Figure 3:
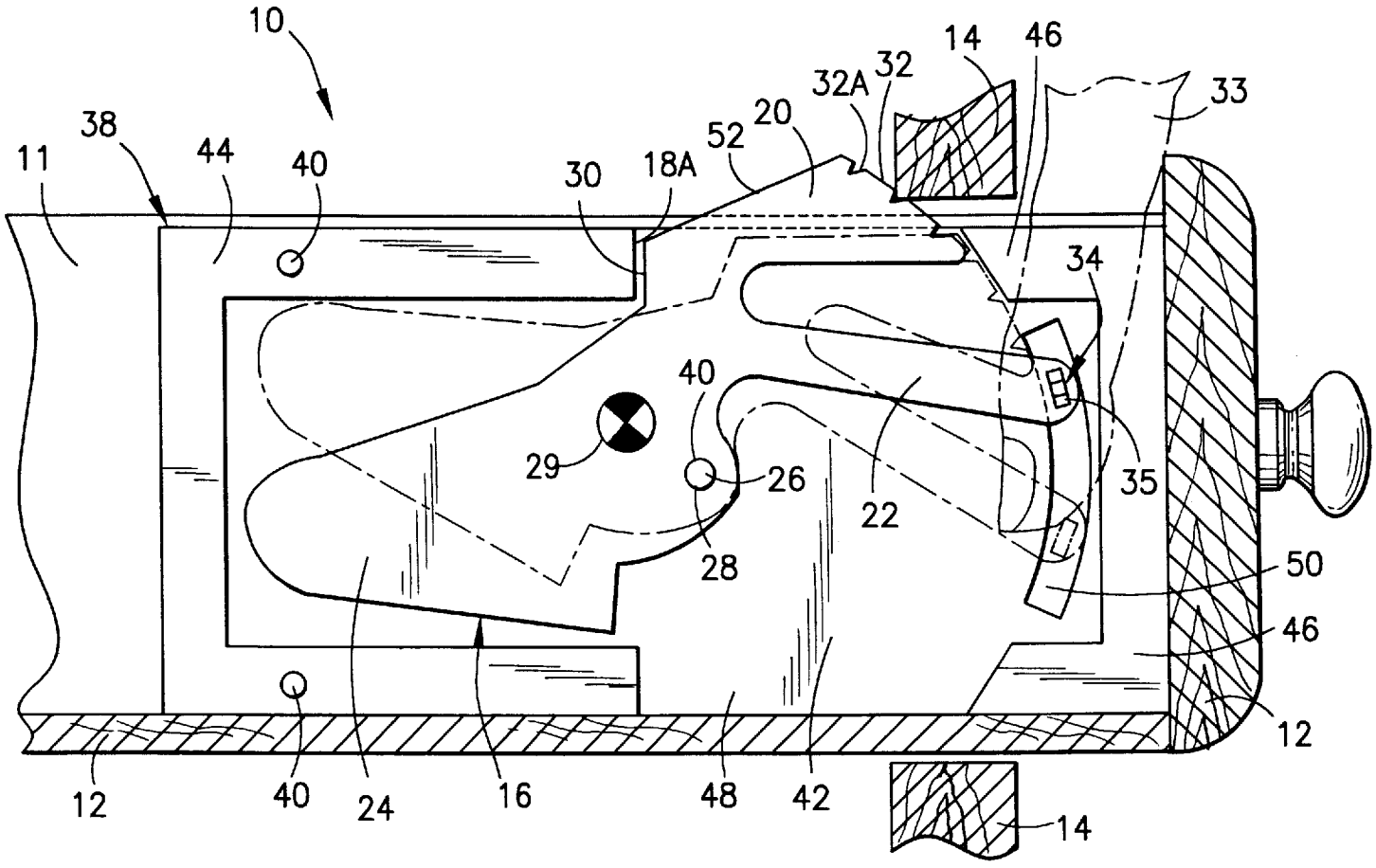
FIG. 3, which is a side elevation view of a second embodiment of a drawer safety lock also embodying the principles of the present invention.

The pivoting latch plate 16, which includes a latch arm 20, a release arm 22 and a counterweight portion 24, is mounted near the top upper edge of sidewall 11 of drawer 12 near its inner front face by a pivot 26 as by a screw 41 which protrudes through an aperture 28 in pivoting latch plate 16, for providing free pivotal movement of the pivoting latch plate 16 between an upwardly pivoted limit position shown in solid lines in FIG. 1, and an unlocked position, drawn in dot-dashed lines, wherein the drawer 12 can be freely opened. The counterweight portion 24 of the pivoting latch plate 16 is selectively shaped with respect to the latch arm 20 and release arm 22 so that the center of gravity 29 of pivoting latch plate 16 is positioned rearwardly with respect to the pivot 26 (as shown in FIGS. 1 and 3) so that pivoting latch plate 16 normally rests in the upwardly pivoted solid-line limit position.

While normally resting in the upwardly pivoted limit position, a stop face portion 30 of the pivoting latch plate 16 rests against the fixed latch plate stop 18. The latch plate stop 18 is a block attached to drawer 12 with a screw 31. As would be well understood by one skilled in the art, the latch plate stop 18 can take any one of a variety of shapes and sizes and can be glued to drawer 12 or attached in any other suitable manner.

Starting with the drawer 12 fully closed and the pivoting latch plate 16 in the upwardly pivoted limit position, opening the drawer 12 causes the drawer frame 14 to engage a cam surface 32 on the latch arm 20. As the drawer 12 is opened further, the engagement between the drawer frame 14 and the cam surface 32 of latch arm 20 causes the pivoting latch plate 16 to pivot until the drawer frame 14 engages one of a series of notches 32A located along the cam surface 32, preventing the drawer 12 from being opened further.

While the drawer frame 14 is engaged with one of the notches 32A, a space between the partially opened drawer 12 and drawer frame 14 allows an adult or older child to use a finger 33 to depress the release arm 22 to unlock the lock 10. Depressing the release arm 22 causes the pivoting latch plate 16 to pivot, withdrawing the latch arm 20 below the drawer frame 14 so that the drawer 12 may be fully opened. As will be appreciated by one skilled in the art, the drawer 12 may need to be closed slightly to disengage the drawer frame 14 from one of the notches 32A and allow the pivoting latch plate 16 to be pivoted to the unlocked position.

Figure 2A:
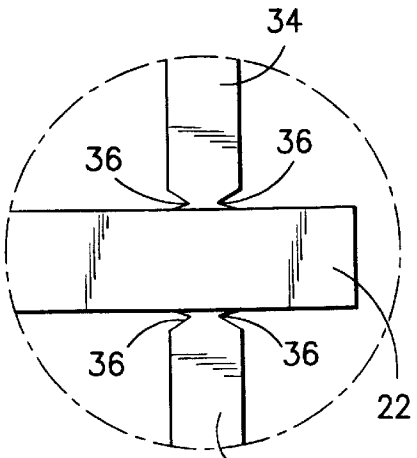
FIG. 2A, which is a fragmentary magnified top plan view of one end of the pivoting latch plate of FIG. 2.
Figure 2:
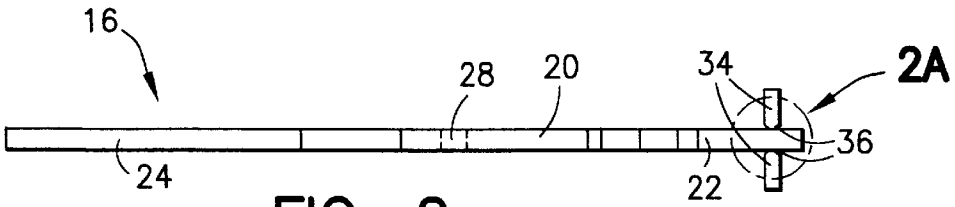
FIG. 2, which is a top plan view of the pivoting latch plate shown in FIG. 1.
Figure 5:
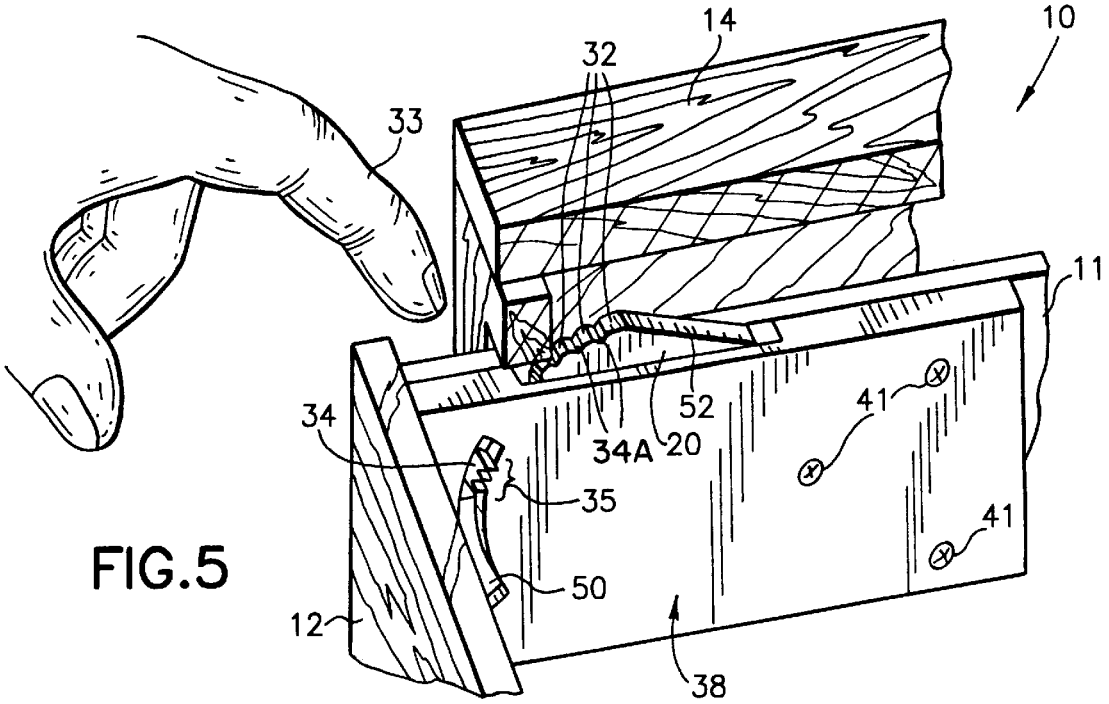
FIG. 5, which is a fragmentary perspective view of the second embodiment of the drawer safety lock of the present invention, shown in the locked position.

The release arm 22 includes release handles 34 with teeth 35 (as best shown in FIG. 5) protruding on both sides of the release arm 22 for aiding in the movement of the pivoting latch plate 16 from the upwardly pivoted limit position to the unlocked position. As shown in FIG. 2A, the release handles 34 include break-off grooves 36 at their roots, so that either or both of the release handles 34 can be easily removed from the latch arm 20. Since the drawer safety lock 10 is designed for use on either sidewall 11 of the drawer 12, it is necessary to be able to remove one of the release handles 34 on one side of plate 16, so that the pivoting latch plate 16 can be mounted with that side substantially flush against either sidewall 11 of drawer 12 without interfering with the drawer 12 or the free pivoting movement of pivoting latch plate 16.

Figure 6:
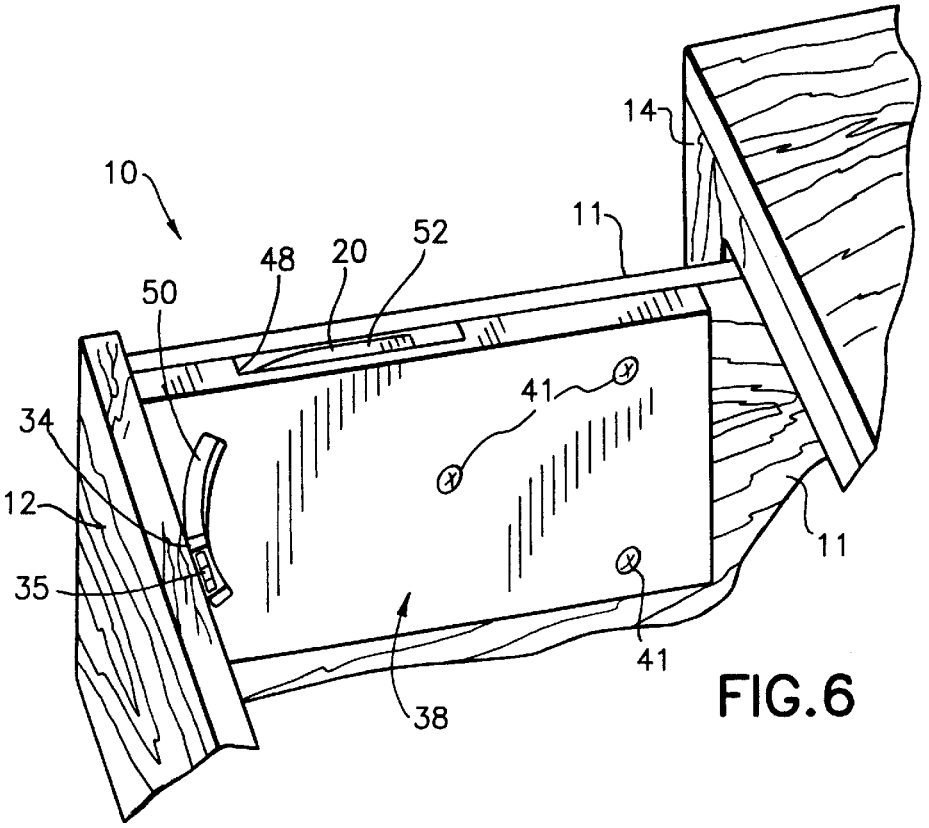
FIG. 6 which is a corresponding perspective view of the second embodiment of the drawer safety lock of the present invention, shown in the unlocked position.

As an alternative to pivotally mounting the pivoting latch plate 16 directly to the drawer 12, the pivoting latch plate 16 may be mounted in a protective housing 38, which embraces and substantially encloses pivoting latch plate 16 in an internal pivoting chamber 39, as illustrated in FIGS. 3–6. As shown in FIGS. 5 and 6, the safety lock 10 of the present invention is more aesthetically appealing when mounted in the housing 38. Most importantly however, the housing 38 prevents any loose articles in the drawer 12 from interfering with the operation of the lock 10. As shown in FIGS. 3 and 4A–4C, the housing 38 includes several apertures 40 for mounting the housing 38 by the user close to the upper edge of sidewall 11 of drawer 12 (FIGS. 3, 5 and 6), with screws 41 or other suitable mounting means, and for mounting the freely pivoting latch plate 16 between drawer sidewall 11 and the housing 38, loosely positioned by another screw serving as the pivot 26. As shown in FIG. 4A, the housing 38 includes a back plate 42, a U-shaped rear wall member 44 and a front end wall member 46. As shown in FIG. 4B, the housing 38 may be fabricated as a single cast or molded piece, with members 44 and 46 integral with back plate 42. Members 44 and 46 are slightly thicker than pivoting latch plate 16, to assure its freedom for pivoting movement in the pivoting chamber enclosed by back plate 42 and wall members 44 and 46.

Figure 4A:
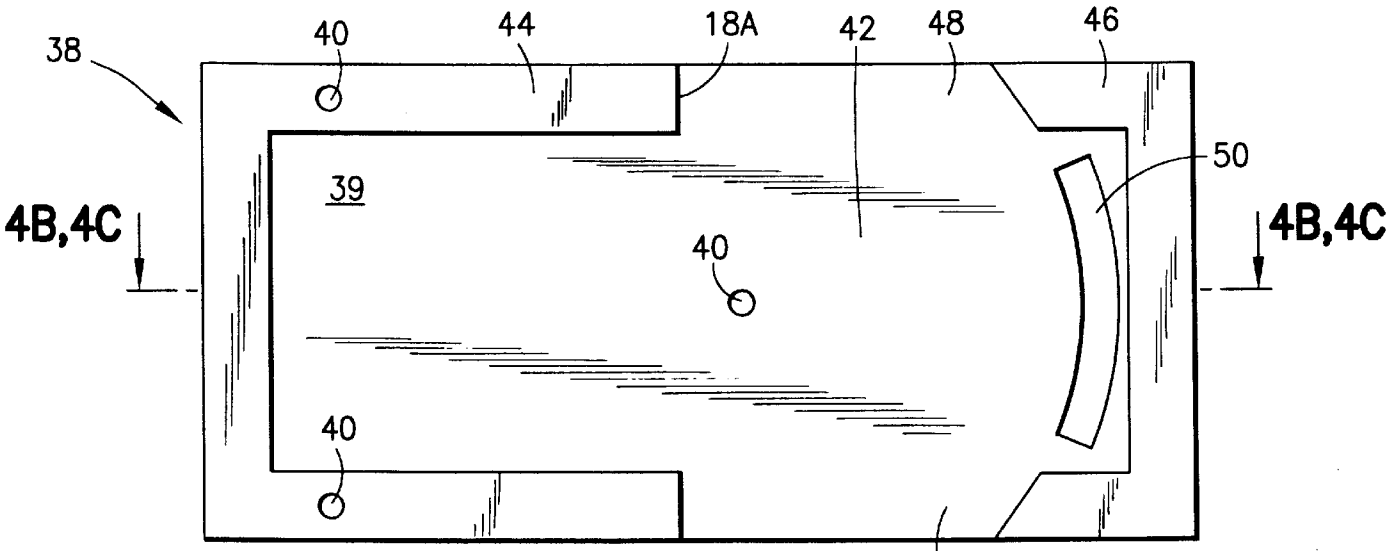
FIG. 4A, which is a side elevation view of the housing of the drawer safety lock shown in FIG. 3.
Figure 4B:
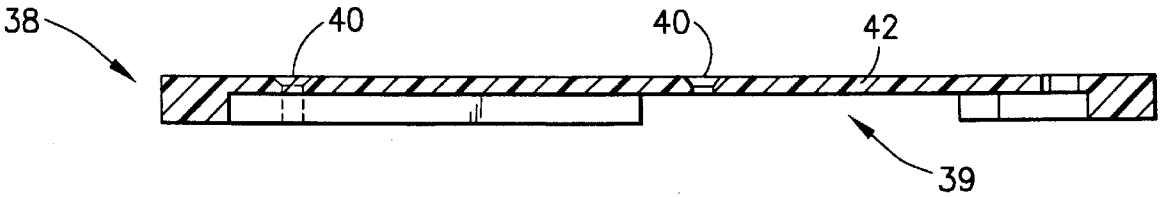
FIG. 4B, which is a cross-sectional top plan view, taken along line 4B in FIG. 4A.
Figure 4C:
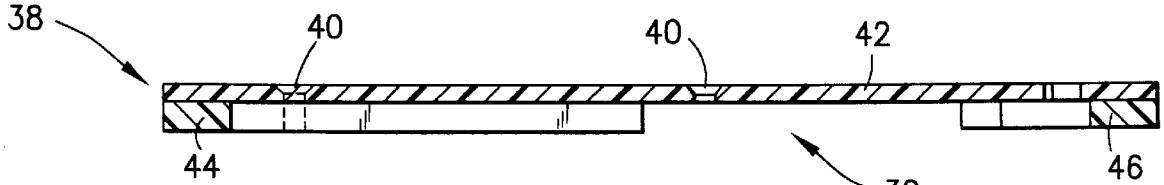
FIG. 4C, which is a cross-sectional top plan view, taken along line 4C in FIG. 4A, of an alternative embodiment of the housing of FIG. 4A.

Alternatively, as shown in FIG. 4C, the back plate 42, the U-shaped rear wall member 44 and the front end wall member 46 may be fabricated separately and then joined together. As would be appreciated by one skilled in the art, the U-shaped rear wall member 44 and front end wall member 46 could be joined with the back plate 42 in several different ways, including, but not limited to being glued or screwed together. Of course, if the back plate 42, U-shaped rear wall member 44 and front end wall member 46 were made from plastic then these pieces could be bonded together using ultrasonic bonding.

Regardless of how the housing 38 is fabricated, when the pivoting latch plate 16 is in the upwardly pivoted limit position, the stop face portion 30 of pivoting latch plate 16 engages an adjacent end 18A of U-shaped rear wall member 44 to limit the upward pivoting of pivoting latch plate 16, eliminating the need for the latch plate stop 18. The housing 38 is shaped to include latch arm slots 48 (FIG. 4A), located on the top and bottom of the housing 38 between end walls 44 and 46, through which the cam surface 32 and notches 32A of latch arm 20 protrude to engage the drawer frame 14. Latch arm slots 48 are provided on both the top and bottom of the housing 38 so that the drawer safety lock 10 can be inverted for use on either sidewall 11 of the drawer 12.

In addition to latch arm slots 48, the back plate 42 of housing 38 also includes an arcuate release handle slot 50, through which the release handle 34 protrudes as the pivoting latch plate 16 pivots within the housing 38.

As would be appreciated by one skilled in the art, regardless of the depth of drawer 12, the lock 10 is mounted in the drawer 12 so that the housing 38 is at or just below the top edge of drawer sidewall 11. When mounted in this position, the cam surface 32 and notches 32A are aligned to engage the drawer frame 14 when pivoting latch plate 16 is in the upwardly pivoted limit position and to avoid the drawer frame 14 when withdrawn into the housing 38 in the unlocked position.

As shown in FIG. 5, the novel drawer safety lock 10 of the present invention allows the drawer 12, sliding in a drawer frame 14, to be opened slightly, so as to allow access by an adult to the release handle 34, while preventing a young child or infant from opening the drawer 12 further. As shown in FIG. 6, with the release handle 34 depressed and the latch arm 20 withdrawn into the housing 38, the drawer 12 can be opened fully.

When the open drawer is closed, a slanting reclosing cam surface 52 of latch arm 20 engages drawer frame 14, which pivotingly depresses the pivoting latch plate 16 downwardly until the reclosing drawer 12 carries the notched cam surface 32 inwardly past frame 14, freeing the counterbalanced pivoting latch plate 16 to pivot upwardly toward its limit position shown in solid lines in FIG. 1.

Although the present invention has been described and discussed herein with respect to one or more embodiments, other arrangements or configurations may also be used that do not depart from the spirit and scope hereof. Hence, the present invention is deemed limited only by the appended claims and the reasonable interpretation thereof.

I claim:

1. A wooden drawer in combination with a drawer frame, Comprising a wooden drawer slidably positioned in a drawer frame, and an attachable drawer safety lock for retrofitting attachment to an interior sidewall of the drawer near its front wall, said drawer being slidable in its drawer frame between open and closed conditions, said drawer safety lock comprising:

a rigid latch plate pivotally attached to the drawer's interior sidewall near its upper edge, at a pivot point near the drawer's front wall and pivotally movable between an upwardly pivoted limit position, wherein the latch plate protrudes upward for engagement behind the drawer frame and prevents the drawer from being fully opened beyond a partially opened locked condition, and a downwardly pivoted unlocked position, wherein the latch plate is disengaged from the drawer frame, freeing the drawer to be fully opened, said latch plate having a release arm forwardly extending inside the drawer, and a rearwardly extending counterweight portion positioning the latch plate's center of gravity rearward of said pivot point, so that said latch plate is unbalanced by gravity to rest normally in the upwardly pivoted limit position, protruding above the sidewall;

and a latch plate stop attached to the same sidewall and positioned with respect to said latch plate for restricting pivotal movement of said latch plate beyond the upwardly pivoted limit position.

2. The wooden drawer and drawer frame combination defined in claim 1, wherein said latch plate includes at least one notch for maintaining engagement between said latch plate and the drawer frame while the drawer is in its partially opened locked condition.

3. The wooden drawer and drawer frame combination defined in claim 1, further comprising at least one manually actuatable release handle attached to the release arm of said latch plate for extending into the interior of said drawer, facilitating the manual movement of said latch plate between the upwardly pivoted limit and downwardly pivoted unlocked positions.

4. The wooden drawer and drawer frame combination defined in claim 3, wherein said attachable drawer safety lock includes two separate release handles, one protruding from each side of said release arm, wherein each said release handle includes a break-off groove near the location where said release handle protrudes from the release arm of said latch plate, so as to provide before attachment for the removal of either of said release handles from said latch plate.

5. The wooden drawer and drawer frame combination defined in claim 4, wherein each said attachable drawer safety lock release handle further includes a plurality of teeth for further aiding in the user's manual movement of said latch plate toward the unlocked position.

6. The wooden drawer and drawer frame combination defined in claim 4, wherein the attachable drawer safety lock latch plate incorporates means forming a transverse pivot aperture at said pivot point, wherein said drawer has two wooden sidewalls, said drawer safety lock being pivotally attached to the interior of one of said sidewalls at said pivot point by a screw extending through said pivot aperture and threadedly engaged in said one sidewall.

7. The wooden drawer and drawer frame combination defined in claim 6, wherein each attachable drawer safety lock latch plate release handle further includes a plurality of teeth for further aiding in the user's manual movement toward the unlocked position.

8. The wooden drawer and draws frame combination defined in claim 1, wherein said latch plate is attached to the interior sidewall of said drawer by a pivot extending through an aperture in said latch plate for providing the pivotal movement.

9. The wooden drawer and drawer frame combination defined in claim 1, wherein said latch plate stop is a block attached to the interior sidewall of said drawer.

10. An attachable drawer safety lock for retrofitting attachment to an interior sidewall of a drawer near its front wall, said drawer being slidable in a drawer frame between open and closed conditions, said drawer safety lock comprising:

a substantially flat rigid latch plate pivotally attachable to the drawer's interior sidewall near its upper edge, at a pivot point near the drawer's front wall and pivotally movable between an upwardly pivoted limit position, the latch plate having a latch arm protruding upward for engagement behind the drawer frame and preventing the drawer from being fully opened beyond a slightly opened locked condition, and manually actuated downwardly pivoted unlocked position, wherein the latch plate is disengaged from the drawer frame, freeing the drawer to be fully opened, said latch plate having a manual release arm forwardly extending inside the drawer, and a rearwardly extending counterweight portion positioning the latch plate's center of gravity rearward of said pivot point, so that said latch plate is unbalanced by gravity to rest normally in the upwardly pivoted limit position, protruding above the sidewall; and a flat housing attachable to said drawer sidewall and enclosing said pivot point and said counterweight portion, incorporating a latch plate blocking stop adjacent to the same sidewall and positioned with respect to said latch plate for preventing pivotal movement of said latch plate beyond the upwardly pivoted limit position, and said housing also incorporating aperture means through which said manual release arm and said drawer frame engaging latch arm protrude beyond said housing.

11. The drawer safety lock of claim 10, wherein said housing includes a latch arm slot and wherein said upwardly protruding latch arm protrudes through said latch arm slot when said latch plate is in the upwardly pivoted limit position, so as to provide for blocking contact between said latch arm and the drawer frame for preventing the opening of the drawer beyond a partially open locked condition.

12. The attachable drawer safety lock of claim 11, wherein said latch plate's counterweight portion is substantially heavier than the combination of said latch arm and said release arm, thus normally pivoting said latch plate by gravity toward its upwardly pivoted limit position.

13. The attachable drawer safety lock of claim 11, wherein said latch arm includes at least one notch for maintaining contact between said latch arm and the drawer frame when said latch arm is in a locked position.

14. The attachable drawer safety lock of claim 13, wherein said latch arm further includes a slanting reclosing cam surface positioned rearwardly of said notch for sliding engagement with said drawer frame, cammingly pivoting said latch plate toward its unlocked position, during closing movement of said drawer in said drawer frame.

15. The drawer safety lock of claim 10 wherein said latch plate's release arm protrudes through said housing aperture means, for facilitating manual movement of said latch plate from its upwardly-pivoted limit position toward its downwardly pivoted unlocked position.

16. The attachable drawer safety lock of claim 15, wherein said release arm incorporates two separate release handles, one protruding from each side of said flat latch plate, each handle including a break-off groove near the location where said release handle protrudes from said release arm, so as to provide for the removal of either said release handle from said latch plate release arm.

17. The attachable drawer safety lock of claim 16, wherein each said release handle further includes a plurality of teeth for facilitating manual actuation of said latch plate from the upwardly-pivoted limit position to the downwardly-pivoted unlocked position.

18. The attachable drawer safety lock of claim 16, wherein said latch plate incorporates means forming a transverse pivot aperture at said pivot point, and said flat housing incorporates means forming at least two transverse mounting apertures near its periphery, further including a drawer having two wooden sidewalls, said flat housing being attached to the interior of one of said sidewalls by screws each extending respectively through one said mounting aperture and being threadedly engaged in said one sidewall, and said drawer safety lock being pivotally attached to the same sidewall by a screw extending through said pivot aperture and threadedly engaged in said same sidewall.

19. The attachable drawer safety lock of claim 18, wherein each said release handle further includes a plurality of teeth for facilitating manual actuation of said latch plate from the upwardly-pivoted limit position to the downwardly-pivoted unlocked position.

* * * * *

UNITED STATES PATENT AND TRADEMARK OFFICE

CERTIFICATE OF CORRECTION

PATENT NO. : 5,769,517

DATED : June 23, 1998

INVENTOR(S) : Felix Carde

It is certified that error appears in the above-indentified patent and that said Letters Patent is hereby corrected as shown below:

In Column 2, line 37 after "Fig. 6" --,-- should be inserted

In Column 2, line 52 after "41" --(FIG. 5),-- should be inserted

In Column 4, line 60 "Comprising" should be --comprising--

In Column 5, line 58 "draws" should be --drawer--

Signed and Sealed this

Twenty-seventh Day of October, 1998

*Attest:*

Bruce Lehman

BRUCE LEHMAN

*Attesting Officer*

*Commissioner of Patents and Trademarks*